United States Patent [19]

Berry, Jr.

[11] 4,402,900

[45] Sep. 6, 1983

[54] DRY SPINNING PROCESS WITH A GAS FLOW AMPLIFIER

[75] Inventor: Walter C. Berry, Jr., Staunton, Va.

[73] Assignee: E. I. Du Pont de Nemours & Co., Wilmington, Del.

[21] Appl. No.: 438,372

[22] Filed: Nov. 1, 1982

[51] Int. Cl.[3] ..... D01F 7/00

[52] U.S. Cl. ..... 264/205; 264/204; 425/72 S

[58] Field of Search ..... 264/205–207; 425/72 S

[56] References Cited

U.S. PATENT DOCUMENTS

| | | | |
|---|---|---|---|
| 1,933,587 | 11/1933 | Dreyfus et al. | 264/207 |
| 1,942,540 | 1/1934 | Dreyfus et al. | 425/72 R |
| 2,131,810 | 10/1938 | Kinsella et al. | 264/207 |
| 3,521,325 | 7/1970 | Schippers | 425/3 |
| 3,737,508 | 6/1973 | Weir | 264/204 |
| 4,123,208 | 10/1978 | Klaver et al. | 425/72 S |

FOREIGN PATENT DOCUMENTS 52-27815 3/1977 Japan .

*Primary Examiner*—Jay H. Woo

[57] ABSTRACT

In conventional dry-spinning processes forming a hollow bundle of filaments, a heated inert gas is introduced to evaporate spinning solvent from the filaments, and a vacuum may be applied in the center of the bundle near the face of the spinneret to assist in drawing the heated inert gas through the filament bundle. A Coanda-flow entrainment device in the center of the bundle adjacent the spinneret face uses a small inlet gas flow directed along a Coanda surface. The device entrains gas, pulling it through the filament bundle and then directing it downward. This entrained flow can supplement or supplant the vacuum-induced flow through the filaments.

2 Claims, 5 Drawing Figures

DRY SPINNING PROCESS WITH A GAS FLOW AMPLIFIER

BACKGROUND OF THE INVENTION

This invention relates to an improved process for dry-spinning polymer solutions to form filaments. More particularly, the process is directed to drawing a flow of heated, inert gas across the filaments emerging from a spinneret, and directing the flow downward into the hollow center of the filament bundle.

Dry-spinning is a well-established method for producing filaments from soluble polymers, and apparatus for dry-spinning is well known. In the usual dry-spinning techniques a hot polymer solution is extruded through spinneret orifices arranged in a series of concentric circles, and then the solvent is rapidly evaporated by introducing a sheath of hot inert gas, called aspiration gas, at the top of the spinning cell and directing it downward around the emerging filaments.

A process wherein a portion of the aspiration gas is removed upward through the center of the spinneret is disclosed by Wier in his U.S. Pat. No. 3,737,508. In Wier's center aspiration process a portion of the aspiration gas introduced in the conventional manner is drawn perpendicularly across the emerging filaments near the exit face of the spinneret by means of a vacuum applied to a conduit provided in the center of the spinning head. This will cause a fresh gas stream to contact the filaments immediately below the spinneret, enhancing solvent removal in a critical zone before a skin has set on the filament surfaces.

The present invention referred to generallly as amplified center flow will be used either to supplement or supplant the center aspiration process of Wier.

SUMMARY OF THE INVENTION

The amplified center flow process of this invention utilizes a Coanda-type flow entrainment device centrally located within the bundle near the spinneret face and fed with a small flow of pressurized inlet gas. The Coanda unit entrains gas from within the center of the filament bundle and thereby amplifies the flow of gas inwardly through the filament bundle. Instead of being withdrawn from the cell as with center aspiration, the flow is redirected downward within the converging, moving filament bundle. This supplies gas to the hollow interior of the moving filament bundle, which is rapidly pumping gas downward due to boundary-layer effects. By satisfying this pumping demand, filament stability improves.

The spinning process of the invention includes the steps of (1) extruding a solution of polymer through a spinneret having orifices arranged in a pattern to form a hollow bundle of filaments, (2) passing a first flow of heated inert gas outside the filament bundle and directing it downwardly and/or inwardly to treat the filaments, (3) introducing a second flow of inert gas along a Coanda surface located near the spinneret face in the center of the hollow bundle (4) thereby entraining a portion of said first flow of gas downwardly with said second flow of gas. The net result is an amplified flow of gas inwardly through the bundle and downwardly within the center of the bundle.

The process may also include the step of creating a vacuum in the center of the hollow bundle of filaments adjacent the spinneret face to assist said first flow of gas inwardly through the bundle.

DETAILED DESCRIPTION OF THE ILLUSTRATED EMBODIMENTS

Figure 1:
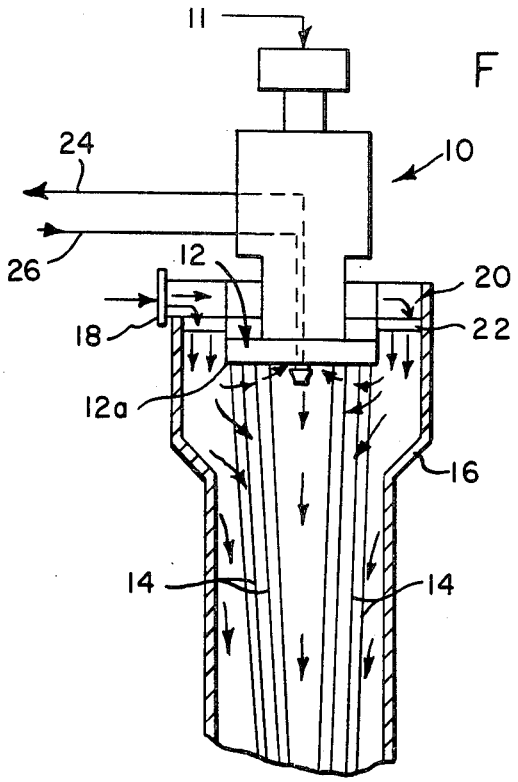
FIG. 1 is a partial schematic vertical cross sectional view of dry-spinning apparatus generally illustrating the process of this invention.
Figure 1A:
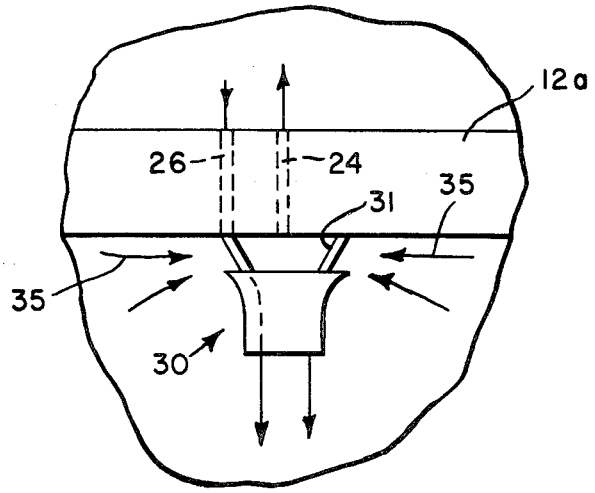
FIG. 1A is an enlarged partial view of FIG. 1 showing the flow entrainment device.

Referring now to FIGS. 1 and 1A, polymer solution from a source (not shown) is injected into a heater 10 as indicated by arrow 11. Heated polymer solution is then distributed to the spinneret 12*a* which has a plurality of concentric holes or orifices arranged in a pattern to form a hollow bundle of filaments 14. Generally, cylindrical casing or chimney 16 is spaced radially outward from spinneret assembly 12 and extends from a level above to a level well below spinneret assembly 12. Connection 18 is provided for injecting a heated gaseous evaporative medium (the aspiration gas) into chimney 16. Ordinarily an annular plenum 20 directs the medium through a diffuser 22 or the like and down around assembly 12 and through the rings of filaments 14 (i.e., a first flow of heated gas). A schematically illustrated conduit 24 extends through the heater 10 and spinneret assembly 12 with a lower terminus communicating with the hollow center of the bundle of filaments 14. The upper terminus of conduit 24 communicates with a vacuum system to provide a center aspiration process as described in the Wier patent referenced above.

Figure 2:
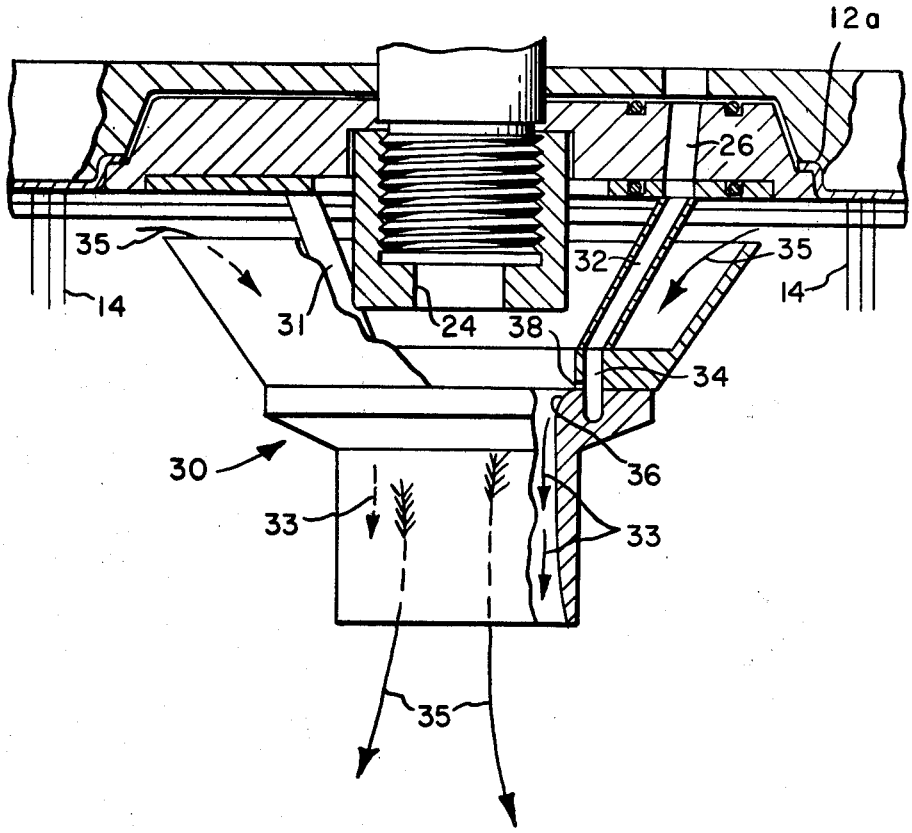
FIG. 2 illustrates one embodiment of a Coanda-type flow entrainment device.

The improvement of this invention utilizes a conduit 26 connected at one end to a source of pressurized gas (i.e., a second flow of gas heated in its travel through heater 10), preferably nitrogen, and at its discharge end to a Coanda-type flow entrainment device 30 mounted to the spinneret assembly 12 by means of supports 31. The Coanda principle is well-known and involves the attachment of a flowing fluid stream to a solid surface. One such device utilizing this principle is shown in more detail in FIG. 2. In FIG. 2 the feed gas or second flow of gas from conduit 26 enters the device 30 at port 32 and is sent through the ring manifold 34 and follows the curved surface 36 as it exits from the groove 38 from the ring manifold 34. This second flow indicated by arrows 33 is oriented in one direction through the torus formed by Coanda attachment to the internal curved surface 36 of the Coanda device 30. The second flow 33 entrains a first flow of heated ambient gas indicated by flow arrows 35.

In operation the device 30 will entrain gas in the center of the filament bundle and cause a flow across the face of the spinneret 12*a*, as does center aspiration. The difference being that instead of being withdrawn from the chimney 16 as with center aspiration taught by Wier, the flow is redirected into the downwardly moving, converging filament bundle. This supplies gas to the hollow interior of the moving filament bundle, which is rapidly pumping gas downward due to boundary-layer effects. Satisfying this pumping demand improves filament stability.

Figure 3:
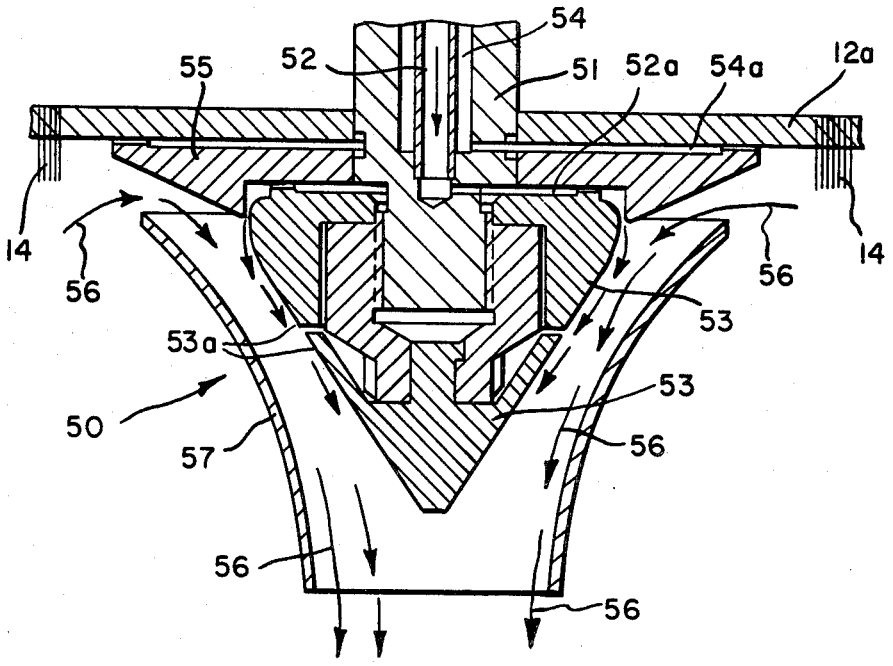
FIG. 3 is a cross sectional view of a second arrangement of a Coanda-type flow entrainment device.

The spinning process of this invention can be practiced with the Coanda device 50 shown in FIG. 3. This particular device is mounted to the spinning pack which includes spinneret 12*a* by means of bolt 51 which extends below the lower face of the spinneret. The device includes a washer 55, a tapered tip 53 and a contoured wall 57 spaced from and surrounding the tip. The tip threads to the bolt 51 and holds the washer 55 in place between the spinneret 12*a* and the tip forming spaces 52*a* and 54*a* between the tip and the washer and the washer and the spinneret. The body of the bolt 51 contains concentric passages 52, 54 which are in communication with pressurized gas and vacuum, respectively, at their other ends.

In operation, center aspiration gas is drawn off through space 54*a* and passages 54 while gas flow is directed down passage 52 to space 52*a* then flows along the surface 53*a* of the tip 53 and is oriented downwardly in one direction thus entraining ambient flow between the wall 57 and surface 53*a* of the tip as indicated by flow arrows 56.

Figure 4:
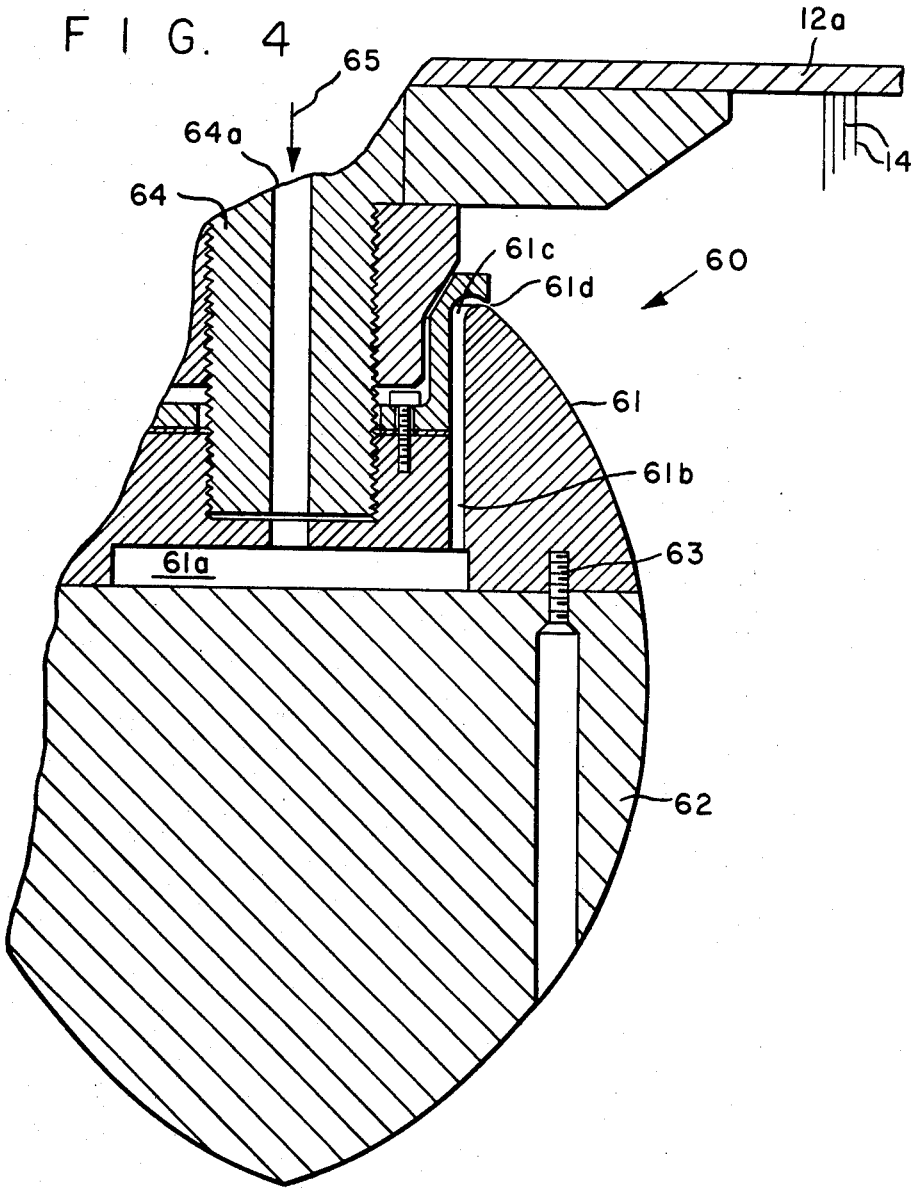
FIG. 4 is a cross sectional view of yet another alternate embodiment of a Coanda-type flow entrainment device useful in practicing the process of this invention.

In yet another embodiment of the Coanda device shown in FIG. 4, the Coanda body 60 is comprised of an upper body section 61 and a lower body section 62 held together by screws 63. The upper body section 61 which includes a cavity 61*a* is threaded to bolt 64 extending from the spinning unit. The bolt contains a central passage 64*a* which at one end is in communication with a source of pressurized gas indicated by arrow 65 and at its other end is connected to cavity 61*a* which in turn connects to passage 61*b* leading to the periphery of the body of 60.

In operation low pressure gas is directed through passage 64*a* to cavity 61*a* from which it flows through passage 61*b* to the periphery of Coanda body 60. The flow follows the surface of the body 60 and is oriented downwardly in one direction, entraining ambient gas in a manner similar to that shown in FIG. 2.

For optimal performance the Coanda gas jet should be in a turbulent flow regime. Entrainment can also be enhanced by making the jet slot 61*d* as narrow as possible. The flow path of the gas (through channel 61*c*) prior to the exit can be varied to meet individual mechanical constraints.

When the improvements of this invention are used with dry-spinning apparatus, it is found to increase productivity without any deleterious effects.

I claim:

1. In a spinning process that includes the steps of extruding a solution of polymer through a spinneret having orifices arranged in a pattern to form a hollow bundle of filaments and passing a first flow of heated inert gas downwardly around and inwardly through the bundle toward its hollow center to treat the filaments, the improvement comprising: introducing a second flow of inert gas along a Coanda surface centrally located within the bundle near the spinneret whereby a portion of said first flow of gas is entrained downwardly with said second flow of gas.

2. The process as defined in claim 1, including the step of creating a vacuum in the center of the hollow bundle of filaments adjacent the spinneret face to assist said first flow of gas inwardly through the bundle.

* * * * *